United States Patent [19]

Miller

[11] 4,430,794

[45] Feb. 14, 1984

[54] DISPOSABLE RAZOR DEVICE FOR CUTTING AND TRIMMING NOSTRIL HAIR

[76] Inventor: William T. Miller, 1633 Cornwall La., Newport Beach, Calif. 92660

[21] Appl. No.: 361,508

[22] Filed: Mar. 25, 1982

[51] Int. Cl.[3] ..... B26B 19/00

[52] U.S. Cl. ..... 30/29.5; 30/50

[58] Field of Search ..... 30/29.5, 49, 50, 90, 30/30, 162, 53

[56] References Cited

U.S. PATENT DOCUMENTS 1,801,889 4/1931 Ventimiglia ..... 30/53 X 3,262,206 7/1966 Tomek ..... 30/50 X

*Primary Examiner*—E. R. Kazenske

*Assistant Examiner*—Douglas D. Watts

*Attorney, Agent, or Firm*—Francis X. LoJacono

[57] ABSTRACT

A disposable razor device for cutting and trimming hair in the nostril passages. The device comprises a hollow, tubular, body member having a dome-shaped end for insertion into the nasal opening, and an opposite end provided with an enlarged base for rotating the body. A pair of inserts are included, each of which has a pair of razor blades formed therein, the inserts being oppositely disposed from each other, and arranged with one pair of razors positioned clockwise and the other pair of razors positioned counter-clockwise, whereby hair can be cut and trimmed by rotating the body of the device with a back-and-forth motion. The device further includes a removable cover.

4 Claims, 3 Drawing Figures

DISPOSABLE RAZOR DEVICE FOR CUTTING AND TRIMMING NOSTRIL HAIR

BACKGROUND OF THE INVENTION

1. Field of the Invention

This invention relates generally to a device for cutting to remove hair from the insides of the nostrils, and more particularly to a disposable device having a plurality of razors disposed in a cylindrical housing which is designed to fit into the nostril passages, in order to engage and cut the projecting hair as the housing is rotated in each nostril.

2. Description of the Prior Art

It is well known in the art that various problems and difficulties are being encountered in providing suitable means for trimming and/or cutting the hair growing inside one's nose and ear cavities.

Most individuals will trim the projecting hair with ordinary scissors, when available. This practice, of course, can be rather hazardous, since there is always the danger of cutting too close and snipping the delicate nostril membranes. Furthermore, the hair projects in various directions from the walls of the nostrils, making it very difficult to cut all of the individual hairs.

There are several devices that have been designed particularly for this type of hair trimming. However, these devices have features that restrict their use, and they very often are too expensive and complicated to be practical for the average individual.

As an example of such a device, U.S. Pat. No. 2,312,933 discloses a rotary clipper device having a safety cutting head with a cutter blade movably mounted therein, the cutter blade being adapted to be spirally rotated within the cutting head by means of a cylinder cam that is mounted to rotate and move longitudinally in a cylindrical housing.

U.S. Pat. No. 3,574,936 discloses a razor for removing objectionable hair from the nostrils, this device comprising a removable blade that is interposed between two elongated blade-embracing members, wherein each blade member includes a plurality of spaced teeth that constitute a guard for the cutting edge of the blade.

Another hair-clipping device is disclosed in U.S. Pat. No. 3,534,473. This device comprises a tubular housing having a slidable cutter means at one end and a push-/pull arrangement at the other end for operation of the cutter element. A spring is employed for shifting the cutter element in one direction. In this particular device, the cutting edge is recessed away from the nostril wall.

U.S. Pat. No. 1,801,889 also discloses a safety razor adapted to removing hair from the inner nostrils or from other parts of the body. The device comprises a tubular shell having a cylindrical portion and a flattened portion having a plurality of slots or kerfs defining spaced teeth, wherein the cutting edge of a blade is disposed. The blade is removably mounted within the tubular shell and is arranged to be replaceable.

Still another safety razor for shaving the insides of the nostrils is disclosed in U.S. Pat. No. 1,522,298 wherein a single blade is employed, the blade being telescopically mounted to a tubular handle.

A cylindrical razor apparatus is disclosed in U.S. Pat. No. 3,299,507. However, this device is not designed to be used for inside the nose, but is provided with multiblade cutting surfaces for selectively shaving one's face, the invention defining a cylindrical blade.

U.S. Pat. No. 2,686,965 discloses a hair clipper adapted to remove hair from inside the nostril and ear canals. This device is comprised of a tubular body having an end portion of a reduced cross-sectional area, the end portion having a plurality of slots, and a plunger reciprocally received in and movable along the longitudinal axis of the body. The plunger includes a cutting head that closely fits the reduced end portion, and coacts therewith to sever the hairs projecting through the slots.

SUMMARY OF THE INVENTION

The present invention has for an important object to provide a disposable razor device for cutting and trimming hair that grows in the nostril passages.

The device comprises an elongated tubular housing formed having a smooth dome-shaped closed end so as to be adapted to be inserted into a nostril passage. The housing is further shaped so as to receive an oppositely disposed pair of razor blades.

It is another object of the invention to provide a safety disposable razor device of this type wherein the sets of blades are arranged with their cutting edges directed in a forward manner against each other. That is, one set of blades is positioned having its cutting edge directed in a clockwise direction, while the other set of blades is positioned having its cutting edges in a counter-clockwise direction—whereby the cutting and trimming action is caused by the back-and-forth rotation of the housing as it is inserted into a nostril.

It is still another object of the present invention to provide a device of this character that has no moving parts and that is relatively inexpensive to manufacture—the overall unit being simple and durable in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

There is illustrated in the accompanying drawings a hair-trimming device adapted to be inserted into a nostril passage, the device being generally indicated at 10.

Figure 1:
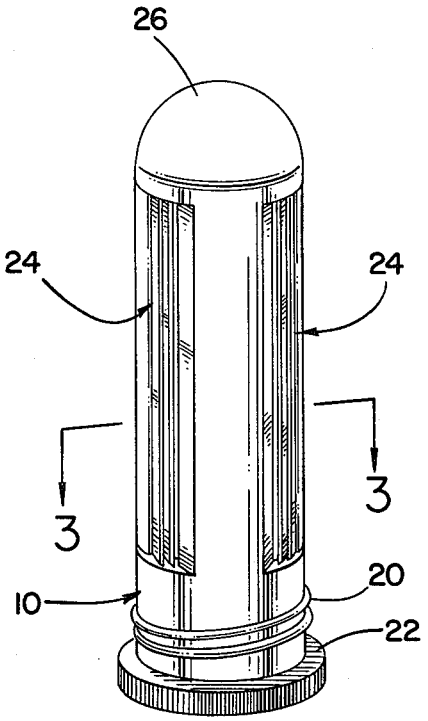
FIG. 1 is a perspective view of a new and unique disposable razor device for cutting the hair in the nostril cavities.
Figure 2:
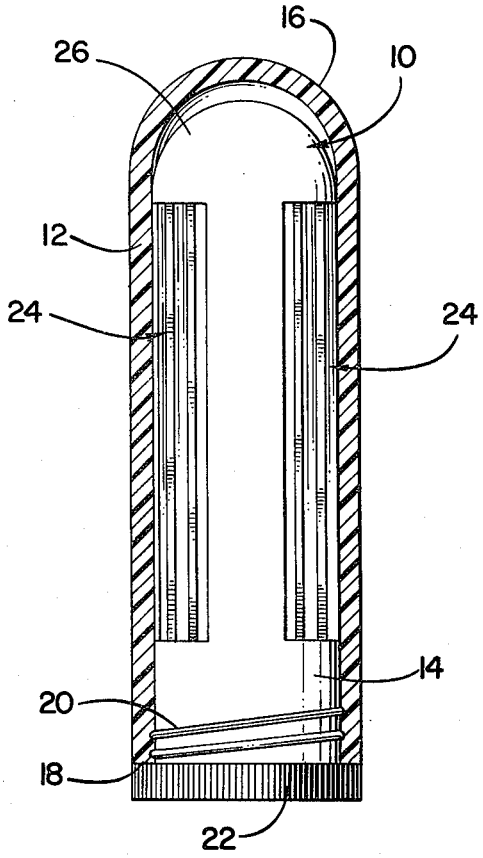
FIG. 2 is an elevational view of the hair-trimming device with a removable protective cover shown in cross-section.

In FIG. 2, the device is shown having a removable exterior tubular casing or cover 12, the main hollow tubular body 14 being formed to be readily received therein. Cover 12 comprises a closed dome-shaped end 16 and an opposite open end 18, the open end being provided with internal threads to receive threads 20 formed on body 14 adjacent the base end 22. Base end 22 is defined by an annular projecting ring which allows one to rotate body 14 with respect to the cover. Thus, it can be seen that cover 12 also protects the cutting means (indicated generally at 24) from damage when not in use, and further prevents inadvertent contact with the cutting means, thereby allowing the device to be carried in the pocket, purse, etc.

The main hollow tubular body 14 is also provided with a dome-shaped head 26 having a very smooth surface for easy insertion into the nostril passage. It is contemplated that both the cover 12 and the body 14 be made from a suitable plastic material.

Figure 3:
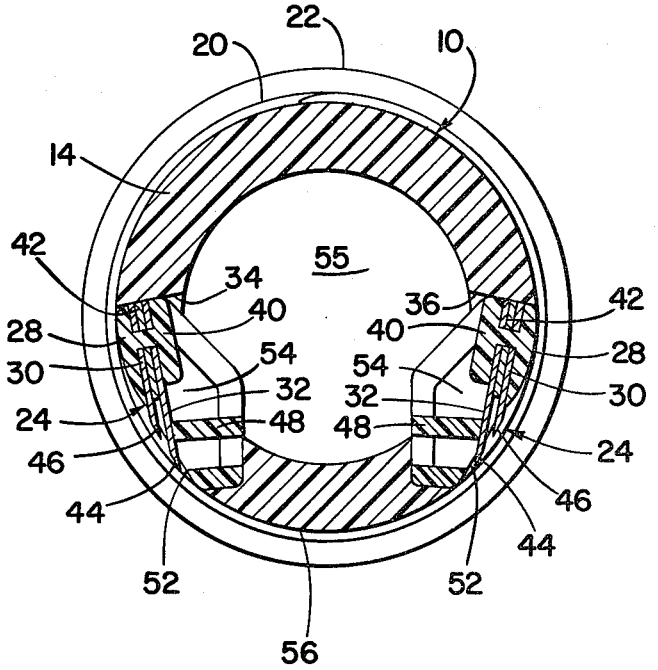
FIG. 3 is an enlarged cross-sectional view of the device taken along line 3—3 of FIG. 1, showing the position of the respective blade structures.

Cutting means 24, defined by a pair of razor-blade inserts, are constructed with a blade-mounting frame 28 in which preferably two juxtaposed razor blades 30 and 32 are disposed. As illustrated in the cross-sectional view of FIG. 3, body 14 includes oppositely disposed elongated openings 34 and 36 in which blade-mounting frames 28 are positioned, the blades 30 and 32 being arranged longitudinally therein. Each mounting frame 28 is fabricated from a suitable plastic material forming a blade-securing frame member 40, a spacer 42 being inteposed between each blade in order to secure them in a properly spaced cutting position.

Blade 32 is provided with a cutting edge 44 and blade 30 has a cutting edge 46, the cutting edge 44 of blade 32 defining the primary cutting edge which extends beyond the cutting edge 46 defining the secondary cutting edge. Blade 32 is further supported by member 48.

Because of the arrangement of the frame structure members 40, 48 and 50 (member 50 being located adjacent cutting edge 44), various through passages 52 and 54 are provided to allow the cut hair to fall within the tubular chamber 55 defined by tubular body 14.

The position and arrangement of blades 30 and 32, with respect to each other and with the outer cylindrical surface 56 of body 14, causes the hair in the nostril to bend in the direction of the primary cutting edge 44, in order to make the first cut, followed by the second cut made by the secondary cutting edge which trims the cut hair even closer to the inner wall of the nostril—without engaging the inner wall itself.

It should be noted that one blade structure can be employed. However, in order that a more satisfactory cutting action be established, it is preferable that a pair of blade structures be used, so that each cutting edge can turn in an opposite direction from the other for a double-cutting effect. That is, one set of blades is positioned in a clockwise direction, while the second set of blades is positioned in a counter-clockwise direction. Hence, once the set of blades is inserted into the nostril passage, it is then twisted with a back-and-forth motion.

It is further contemplated that the blade structures, which include blades 30 and 32, be adapted for easy removal and disposal, and the insertion of new blades when necessary.

The invention and its attandant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A disposable razor device for cutting and trimming the hair on the inner surfaces of the nostril passages, the device comprising:

a main tubular body member having a dome-shaped end adapted to be alternately inserted into each of said nostril passages;

means formed on the opposite end of said body to rotate said body;

razor-cutting means mounted longitudinally along said body member and recessed therein;

said razor-cutting means comprising a razor-blade insert which includes:

a razor-blade-securing frame member, a first razor blade secured in said frame member, a second razor blade secured in said frame member and space from said first razor blade, and juxtapositioned thereto;

a first razor-blade insert; and a second razor-blade insert;

each of said razor blade inserts being mounted in said body and being oppositely positioned from each other;

a removable cover member adapted to be removably secured to said body to cover said razor-cutting means.

2. A disposable razor device as recited in claim 1, wherein said first razor-blade insert is positioned to cut when said body is rotated in a clockwise direction; and wherein said second razor-blade insert is positioned to cut when said body is rotated in a counter-clockwise direction.

3. A disposable razor device as recited in claim 2, wherein said first razor blade has a cutting edge that extends outwardly from the cutting edge of said second razor blade, whereby said cutting edge of said first razor blade defines the primary cutting means which cuts the hair, and whereby said cutting edge of said second razor blade defines the secondary cutting means which trims the remaining portion of the hair adjacent the inner surfaces of each of said nostril passages.

4. A disposable razor device as recited in claim 3, wherein said razor-blade-securing frame member comprises:

a first frame-structure member adapted to secure said razor blades in said structure;

a second frame-structure member positioned to engage and support said first razor blade adjacent said cutting edge thereof; and a third frame structure member positioned adjacent said cutting edge of said first razor blade, and spaced therefrom to allow cut hair to pass therebetween;

said main body member including a chamber to receive said cut hair.

* * * * *